United States Patent [19]

Bernardy

[11] Patent Number: 5,048,230

[45] Date of Patent: Sep. 17, 1991

[54] SUPPORT FOR CHRISTMAS TREE OR ANALOGOUS

[76] Inventor: Félicien Bernardy, Rue de Grendel 4, 6702 Attert, Belgium

[21] Appl. No.: 320,099

[22] PCT Filed: Jun. 1, 1988

[86] PCT No.: PCT/BE88/00020

§ 371 Date: Jan. 27, 1989

§ 102(e) Date: Jan. 27, 1989

[87] PCT Pub. No.: WO88/09638

PCT Pub. Date: Dec. 15, 1988

[30] Foreign Application Priority Data

Jun. 2, 1987 [BE] Belgium ..... 8700612

[51] Int. Cl.[5] ..... A47G 33/12

[52] U.S. Cl. ..... 47/40.5

[58] Field of Search ..... 47/40.5; 248/519, 523, 248/524, 529

[56] References Cited

U.S. PATENT DOCUMENTS

| | | | |
|---|---|---|---|
| D. 290,099 | 6/1987 | Andersson | 47/40.5 |
| 2,617,617 | 11/1952 | Krastel et al. | 47/40.5 |
| 2,639,877 | 5/1953 | Fox | 47/40.5 |
| 2,904,291 | 9/1959 | Harbes et al. | 47/40.5 |
| 4,310,989 | 1/1982 | Shannon, Jr. | 47/40.5 |

*Primary Examiner*—Richard E. Chilcot, Jr.
*Assistant Examiner*—Michele A. Van Patten
*Attorney, Agent, or Firm*—Watson, Cole, Grindle & Watson

[57] ABSTRACT

A conserving device for plants includes a receptacle, a support member formed of two retaining elements of which at least the first one is provided with fasteners enabling it to be fixed in a detachable and/or movable manner to the receptacle, and fixing elements which are provided for connecting the second retaining element, in a detachable and/or movable manner, to the receptacle or to the first retaining element as well as tightening elements which submit both retaining elements to forces for bringing them mutually together in such a manner that the trunk of the plant disposed between the two retaining elements is tightened in a manner adapted to its diameter.

19 Claims, 3 Drawing Sheets

SUPPORT FOR CHRISTMAS TREE OR ANALOGOUS

The present invention relates to a method for conserving plants having a trunk of a large dimension, particularly of the Christmas tree type, comprising the introduction of the trunk of the plant into a receptacle and its immobilization in a stable manner in the receptacle, in a set up position, as well as a regular water supply. It also concerns a conservation device comprising a receptacle in which the trunk of the plant is introduced, the receptacle being formed by a bottom, from which a peripheral casing juts out upwardly, and being open upwardly, and retaining means which are able to maintain said trunk in a set up position in the receptacle, as well as means for stabilizing the receptacle on the soil. The invention also concerns a support member to be used for such a conservation.

One of the drawbacks of Christmas trees is well known, they dry up quickly, their needles then fall on the ground and their use inside is thus of short time. On the other hand, it concerns plants sometimes of large dimensions which are difficult to introduce into a receptacle, such as a pot, and above all to be maintained in a set up position.

Receptacles are known which are provided with means for retaining the trunk of the fir introduced therein. Those means only enable the introduction of the cut trunk of the fir through a passage having a limited aperture foreseen in the middle of the receptacle. There the trunk is then blocked by means of blocking means and the pot is stabilized by external stays taking a lot of place.

Those receptacles do not enable the introduction of the trunk of the fir provided with its roots, a lump of earth or a container filled with earth. The introduction of the trunk into the central passage of the pot is not easy when the fir has a large weight and usually several persons are required in order to perform that operation. Finally, the used receptacle has a dedicated and obligatory form and not every pot can be used for that purpose.

On the other hand, when the fir is provided with a lump or with a container, usually the lump or the container is planted into a larger receptacle and earth is added in order to fill it. Eventually the fir is stayed as much as possible and then water is added in order to lightely moisten the earth without liquifying it. As soon as too much water is added, the earth will not longer retain the trunk of the fir which could then bend or fall down.

Under those conditions, it is thus impossible to correctly supply water to that fir, which explains its quick dry up, particularly when it is submitted to very bad climatic conditions of a heated interior of a living room or a reception hall, a.s.o.

On the other hand, it has been observed that when only put into water, the trunk which is not provided with its roots could present an aspect of improved freshness for a little longer than the trunks put into moistened earth. Although this improvement is of short time and in any way unsufficient, because, like cut flowers put into water, the firs of which the trunk is cut jeopardy after a certain time.

Finally, the sales of firs with a lump of earth or a container is not an environment friendly solution because it degrades and let quickly disappear the soil from which the firs are extracted.

It is an object of the present invention to find a solution for those drawbacks mentioned herebefore by making use of a method and a conversation device as well as a support member which enable to conserve during a longer period and in a fresh and vigourous state, a plant having a larger trunk, particularly a Christmas tree, in the bad conditions of the interior of a home. The method and the device according to the invention must enable to eliminate the quick dry up of the Christmas trees and to let in a large way disappear the danger of fire which they represent. The method and the device for supporting and fixing must among other be simple, even for not so strong persons, and the device must above all be universal, that is to say adaptable to any type of fir, cut or not, with a lump of earth or a container or only with roots. Finally, the support member must be adaptable to most of the pots and plant receptacles used on the market.

This problem is solved according to the invention by using a method such as described in the beginning, that method comprises the fixing of the trunk to the receptacle, in a manner adapted to its diameter, even when the trunk is still provided with its roots, a lump of earth or a container, and the stabilization of the receptacle by filling it with water which not only serves for feeding the plant and conserving it in strength and freshness, but also fot ballasting the receptacle.

One can also provide, according to the invention, a device for the conservation of plants having a trunk of a large dimension, particularly of the Christmas tree type, such as described in the beginning, that device comprises as retaining means, a support member constituted of two retaining elements of which at least the first one is provided with fastening means enabling it to be fixed in a detachable and/or movable manner to the receptacle and fixing means which are provided for connecting the second retaining element, in a detachable and/or movable manner, to the receptacle or to the first retaining element, in such a manner that the two retaining elements are disposed on both sides of the trunk, as well as tightening means which submit both retaining elements to forces bringing them mutually together in such a manner that the trunk of the plant disposed between the two retaining elements is fixed in a manner adapted to its diameter, the trunk having been cut at its base beforehand or being still provided with its roots, a lump of earth or a container filled with earth.

Finally, according to the invention, a support member is provided which comprises two retaining elements of which the first one is provided with fastening means enabling to fix it in a detachable manner to any receptacle, and fixing means which are able to connect, in a detachable and/or movable manner, the second retaining element to the first retaining element in such a manner that the two retaining elements are disposed on each side of the trunk, this one still being outside of a receptacle provided for receiving it or already inside the latter, and the first retaining element being already fixed or not to the receptacle by its fastening means, and tightening means which submit both retaining elements to forces bringing them mutually together in such a manner that the trunk of the plant disposed between them is fixed in a manner adapted to its diameter, the trunk having been cut at its base beforehand or being still provided with its roots, with a lump of earth or with a container.

Other details and particularities of the invention will become clear from the description given hereunder, by way of a non-limiting example, with reference to the annexed drawings, as well as from the claims which follow.

Figure 1:
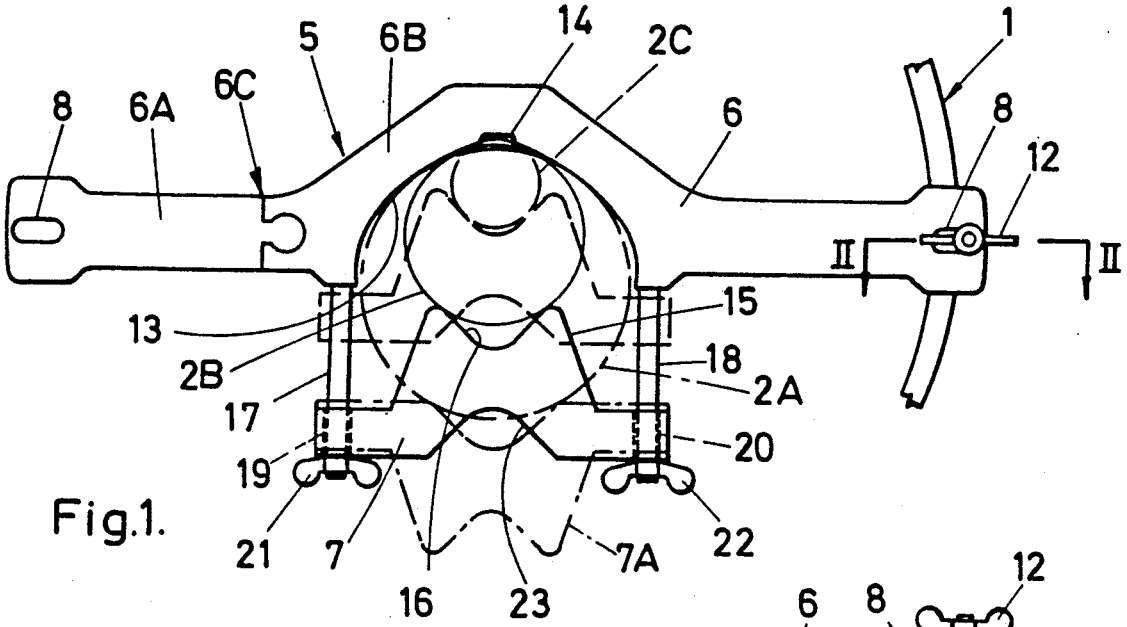
FIG. 1 represents a top view of an embodiment of a conservation device according to the invention.
Figure 2:
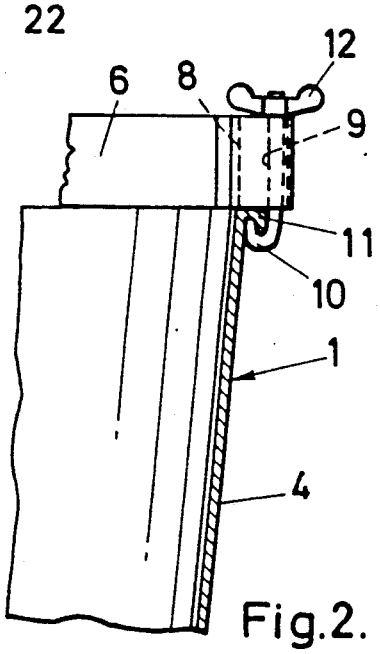
FIG. 2 represents a cross-section according to the line II—II of FIG. 1, at an enlarged scale.
Figure 3:
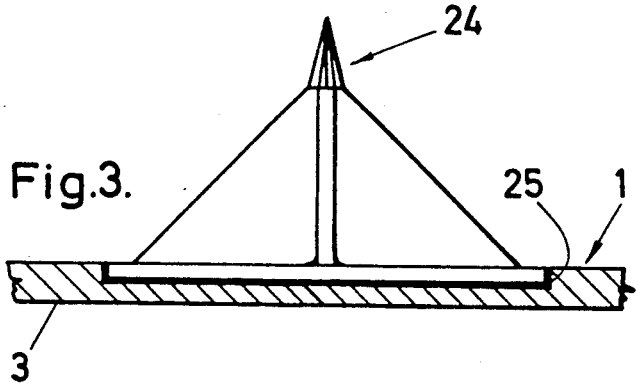
FIGS. 3 and 4 represent a lateral view and a schematic view of an embodiment of the support member, provided in the bottom of the receptacle.
Figure 4:
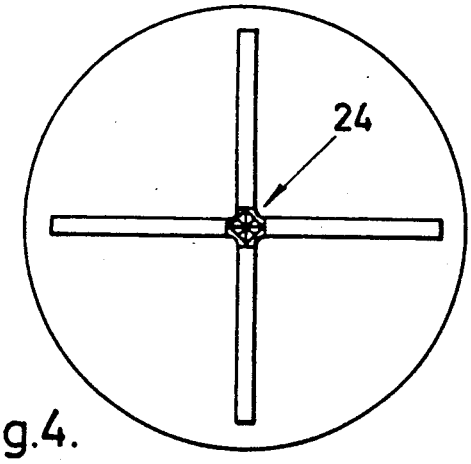
Figure 5:
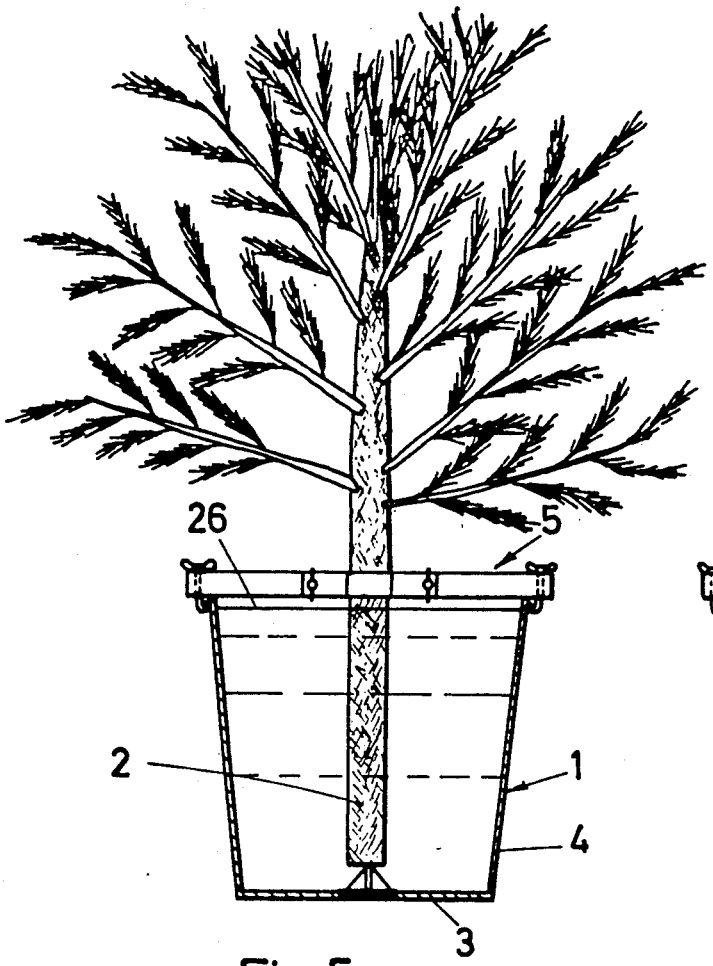
FIGS. 5 to 8 illustrate the universality of the application of a device according to the invention.
Figure 6:
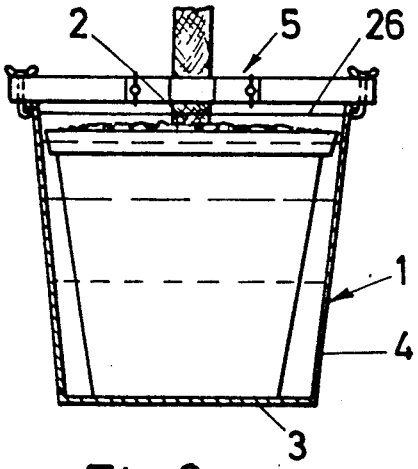
Figure 7:
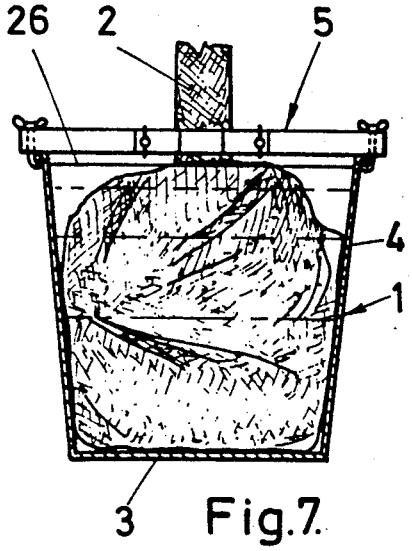
Figure 8:
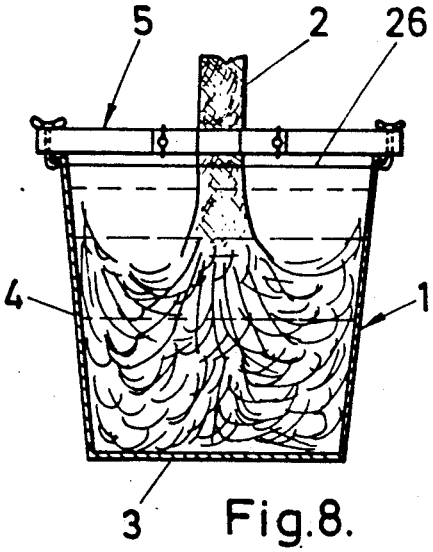

On the different drawings, identical or analogous elements are referred to with the same reference.

On FIGS. 1, 2 and 5 to 8 a device is illustrated for conserving plants having a trunk with a large dimension, particularly a Christmas tree. This device comprises a receptacle 1 in which the trunk 2 of the plant is introduced. The receptacle 1 is formed by a bottom 3 from which a peripheral casing 4 juts out upwardly.

The illustrated receptacle is of the type of a bucket in plastic or metallic material or of a pot in a ceramic material, but it will be clear that its form and the material of which it is realized are not critical. The receptacle must of course be open upwards in order to enable the introduction of the trunk of the plant.

The device according to the invention comprises moreover, in its embodiment illustrated on the figures mentioned herebefore, a support member 5. As it becomes clear, particularly from FIG. 1, this member comprises two retaining elements 6 and 7. The first retaining element 6 is provided with fastening means which enable to fix it to the receptacle in a detachable and movable manner. In the embodiment illustrated by way of example on FIG. 1, those fastening means comprise elongated holes 8 provided at the end of the retaining element 6, in such a manner as to enable an adjustment of the length of the retaining element 6 to the diameter of the receptacle 1 and a lateral adjustment to the plant. The fastening means mentioned herebefore comprise inter alia fastening shafts 9 threaded at one end and in the form of a hook 10 at the opposite end. That hook is provided in order to grip at the underside on the border 11 of a current receptacle for plants and the illustrated embodiment of that hook is only given by way of example. The threaded shaft 9 can slide through the holes 8 and the fastening means mentioned herebefore comprise inter alia wing nuts 12, which serve to tighten the retaining element 6 against the border 11 of the receptacle 1. When one of the fastening means is detached and the screw 12 of the other is a little bit unfastened, it is even possible that the fastening shaft 9 serves as a rotation axis for the retaining element 6 (see FIG. 9). This set-up enables thus a detachable fixing or simply movable of the retaining element 6 to the receptacle 1. This fixing can among others take place before or after the introduction of the trunk into the receptacle, because even in a position fixed at one side, it leaves the opening of the receptacle free for the passage of the trunk, even if it is still provided with its roots, a lump of earth or a container.

The first retaining element 6 as illustrated in FIG. 1 is a rod in a resistant material of any nature. Its length is at least equal to the one of the above aperture of the receptacles currently used for planting Christmas trees inside. Instead of elongated holes 8 described hereabove, one can also provide other current set-up, for adapting the length of the rod 6, such as for example a telescopic set-up (see FIG. 11). One can also provide, as illustrated on FIG. 1, that the rod 6 is formed by two parts 6A and 6B which can be joint (in 6C), in such a manner as to be able to put the rod 6 in the bottom of the receptacle when it is not used.

The second retaining element 7 of the support member of the device according to the invention is, in its embodiment illustrated on FIG. 1, formed by a rod of a resistant material of any nature. Advantageously its length is less than the aperture of the receptacle.

On FIG. 1, fixing means are provided for connecting in a detachable and/or movable manner the rod 7 to the rod 6. Those means comprise two shafts 17 and 18 which jut out parallel on one side of the rod 6. Those shafts 17 and 18 are mutually separated by a distance larger than the maximum and usual diameter of the trunks of firs to be conserved inside. Their length is sufficient so that, when the trunk of the fir is supported by the rod 6, among them they still jut at least a little bit out of said trunk. The free ends of those shafts 17 and 18 are threated and are able to slide through perforations 19 and 20 provided in a corresponding manner in the rod 7. As fixing means cooperating with the shafts 17 and 18, finally wing nuts 21 and 22 are provided to be screwed onto the threaded free ends of the shafts 17 and 18 which jut out over the perforations 19 and 20 of the rod 7. This set-up thus enables to dispose both retaining elements 6 and 7 on both sides of the shaft, by connecting them mutually. If only one of the screws 21 or 22 is unscrewed and the other one is only slightly unscrewed, it is also possible to let the rod 7 rotate around the axis formed par one of the shafts 17 or 18 (see FIG. 9).

In the example of the embodiment illustrated on FIG. 1, the fixing means 17 to 21 simultaneously form the tightening means which, when tightened, submit both retaining elements to forces bringing them mutually together, in such a manner that the trunk of the plant disposed between them can be tighten in a manner adapted to its diameter.

The rod 6 presents, in the example of the embodiment illustrated in FIG. 1, a support zone 13 for the trunk 2 of the fir. This first support zone 13 is essentially provided in the center of the rod 6 under the form of the lateral recess. The first support zone 13, in a schematic view, has mainly the shape of an arc of a circle, the diameter of which corresponds approximately to the maximum diameter of the trunk of plants to be maintained inside (see trunk 2A represented in mixed dots on FIG. 1). That support zone 13 is also provided, at its bottom, with a vertical groove 14. In this way, when the trunks have a diameter which is smaller than the one of trunks 2A, they always dispose of at least two contact points with the support zone 13 (on FIG. 1, see trunk 2B represented in full lines and trunk 1C represented in interrupted lines). The support zone 13 can advantageously be provided with anti-friction means, as for example a grooving such as illustrated on FIG. 9.

In the middle of one of its faces, the rod 7 presents a jut out 15, the top of which is provided with a recess forming a second support zone 16 for the trunk of the fir. The height and the width of this jut out 15 are provided in a manner that they can eventually penetrate within the recess formed by the first support zone 13, when rods 6 and 7 are tightened around a trunk of small diameter, such as trunk 2C. The dimensions of the jut out 15 are however such that they cannot come into contact with the first support zone 13.

In the example illustrated on FIG. 1, the second support zone 16 is formed by two flaps disposed perpendicularly one to another and forming a recess in the form of a V. In this way, this support zone is always in contact with the trunk of the fir and on at least two points in a position of tightening the trunk. In this position one thus always obtains four contact points between the support member and the trunk of the tree, making it a very safe fixing. It is obvious that other realization forms of the support zones could be provided. For example, the support zone 13 could also be conformed in a V form.

On the rod 7, there is foreseen, on the side opposite to the second support zone 16, a potential supplementary support zone 23 formed by a recess constituted by two inclined flaps in form of a V. Compared to difference of the recess forming the support zone 16, the support zone 23 is not recessed in a jut out of the rod and can advantageously be used for larger trunks of plants, by mounting the rod 7 on the fixing shafts 17 and 18 in a reversed position (see the position of the rod 7A represented in mixed dots on FIG. 1).

Figure 9:
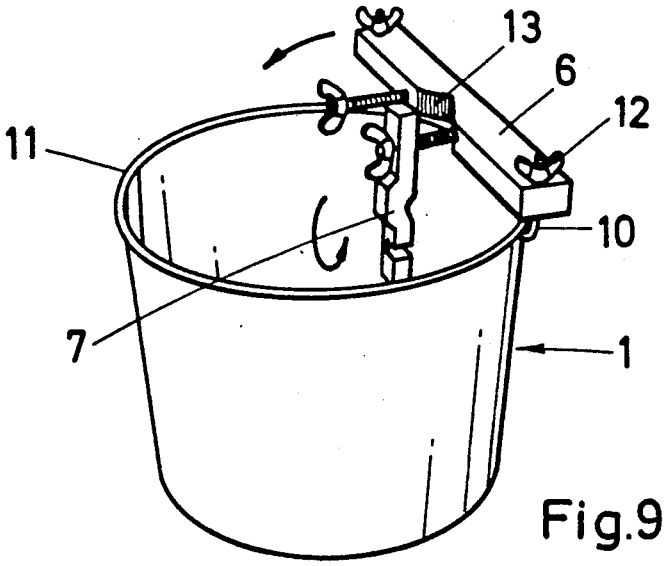
FIG. 9 represents a perspective view of a device according to the invention before the introduction of the trunk.

All those support zones 16 and 23 can of course be provided, in a non represented way, of anti-friction means such as a grooving analogous to the one illustrated on FIG. 9 for the zone 13.

One can also provide, at the bottom 3 of the receptacle, a maintaining member 24 having the form of a point on which the trunk of the fir can be picked, when use is made of a trunk cut beforehand. Because that member is not necessary in other cases, its lodging is provided in a recess 25 of the bottom 3, in which it can be inserted and from which it can then easily be taken out.

The stabilisation means of the device according to the invention are constituted by water of which the upper level 26 is represented on FIGS. 5 to 8. The water thus does not only serve as nutrition source for the firs but also as stabilization means for the receptacle and thus for the fir planted inside the latter.

The conservation device which has been described will now be used in a way given hereunder:

The rod 6 is in a position fastened at its both ends on the border of the receptacle 1. The rod 7 is sufficiently put away from the rod 6 by a progressive unscrewing of the screws 21 and 22. The trunk is then introduced into a passage formed between the rods 6 and 7 and the two fixing shafts 17 and 18. This process, even as the state of the art, does not enable the fixing of trunks cut beforehand.

Figure 10:
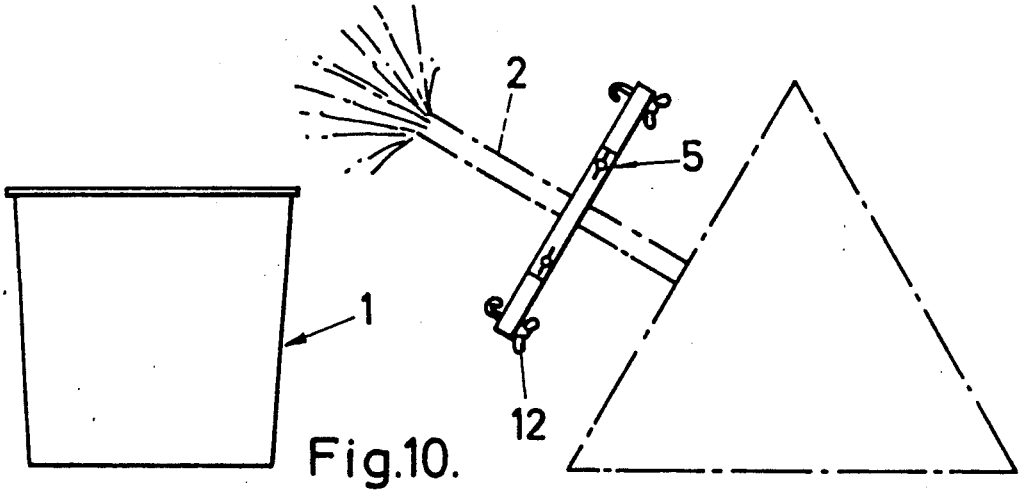
FIG. 10 represents a perspective view of the trunk of a fir provided with a support member according to the invention before the introduction of the trunk into a receptacle.

One can advantageously either completely detach the support member 5 from the border of the receptacle 1, by completely unscrewing the screws 12. In the same way, the rod 7 is completely detached from rod 6. The trunk 2, still outside the receptacle, is passed between the fixing shafts 17 and 18 of the rod 6, then the rod 7 is screwed again on the shafts 17 and 18. After tightening of the trunk 2 between the rods 6 and 7, such as illustrated on FIG. 10, the whole is placed into the receptacle and the rod 6 is again fastened on the border of the receptacle by screwing the screws 12. That way of proceeding, as well as the one described hereunder, is not limited to a cut trunk, but enable all putting into a pot illustrated on the FIGS. 5 to 8.

One can also detach the rod 6 at one end and slightly unscrew the screw 12 at the other end, in such a manner as to let the rod 6 rotate outwardly, around the hook element 9, 10. This operation enables a large opening of the aperture of the receptable. In the same way, one of the screws 21 or 22 is detached and the rod 7 is taken away from one of the fixing shafts 17 or 18, while the other screw is only unscrewed. This enables a downwards rotation of the rod 7 around one of the fixing shafts. The thus obtained position is illustrated on FIG. 9. In this position, the trunk 2 can be put into the receptacle and then by rotation of the rods and screwing again of the screws, the two rods can be screwed on both sides of the trunk.

After all those operations, or before them, the receptacle is filled with water and balasted by it. That water is constantly maintained at a filling level such as illustrated by the reference 26 on the FIGS. 5 to 8.

Figure 11:
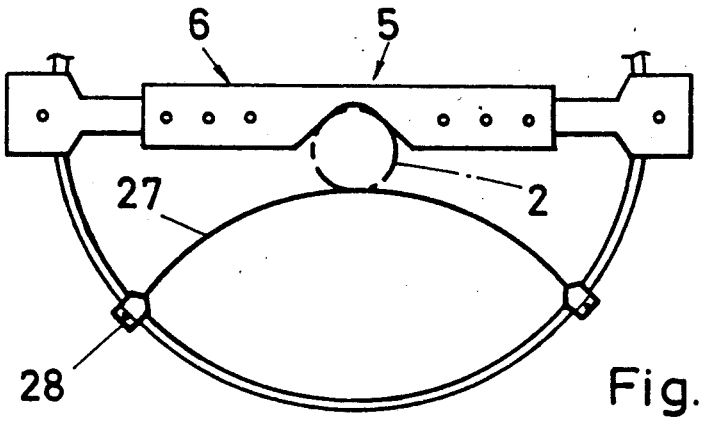
FIG. 11 represents a view from the bottom side of another embodiment of a device according to the invention.

Another embodiment of a device according to the invention is illustrated on FIG. 11. At a difference of the device according to FIG. 1, the supporting member 5 comprises a first retaining element in the form of a telescopic rod 6. The second retaining element is a spring 27, for example of the type of a blade, which can be fixed, not on the rod 6, but on the upper border of the receptacle, by fixing means 28 of a known type. The fixing means are here formed by the spring self and simultaneously by the rod 6 which can be brought closer to the spring 27.

The big advantage of such a device according to the invention and of its support member is thus to enable the placing of a fir in a receptacle whatever be the state of its trunk, with or without roots. It enables on the other hand to provide feeding water to the fir, as a ballast for the device, which thus remains without taking too much place and very stable.

In an unexpected manner, a fir provided with its roots and holded in a conservation device according to the invention feels a totally unusual freshness and strength, which is not known by firs provided with some roots and a lump of earth and of which the earth is only moistened in a current way. Indeed, those latters, when not properly feeded with water, can continue to live a certain time inside a house. However, this feeding cannot be done in the conditions really required by a fir in order to be in perfect strength and freshness, because then the feeding water liquifies so the compost added in the receptacle that it is no longer able to retain on its own the fir introduced into the receptacle.

The applicant has planted at the end of December a fir provided with roots, without earth, by making use of a conservation device according to the invention. The fir has thus been maintained in the boiler room of his house, that is to say in the worst conditions that can exist. However, two months later, one could establish that non only the fir was still living but also that it had moreover bud and that branches until 14 cm of length had grown, and that it had not lost anything from its glitter. On the other hand, it had not stopped during that whole period to parfume the house with the particular resinous smell, which can be perceived by walking through the fir woods, after heavy rain. There has not been observed an abnormal lost of needles around the fir.

The used device and method enable moreover to reduce or eliminate the amount of earth to be removed during the throwing out of a fir. That enables not to extract a lot of earth out of the original soil which, at long term, represents a non-neglectible factor of impoverishment of that soil. On the other hand, firs without lump do not necessitate a short cutting of the roots, such as imposed by the realization of the lump. More radicels can be left to the supplied fir.

Finally, as could be imagined, the method according to the invention enables the conservations of firs inside in conditions of greater security against fire.

It has to be understood that the present invention is in no way limited to the embodiments described hereinabove and that a lot of modifications can be brought to them without leaving its scope.

Support zones of different forms can for example be provide only three contact points between the trunk and the support zones (see FIG. 11).

A second retaining element can also be provided in the form of an elastic grip, which, instead of being fixed, as it is the case of the spring 27 of FIG. 11, on the receptacle, would be fixed to the first retaining element.

One can also add, to the feeding water, an adapted composition of additives for the culture of the concerned plant.

Finally, it is evident that the method and the conservation device as well as the support member described hereabove can be used for the outside conservation of plants.

I claim:

1. A stand device for a plant having a large diameter trunk which comprises a receptacle in which said trunk can be inserted and which has a bottom and an upwardly-extending side that defines a peripheral upper edge, and a support means for supporting said trunk in position within the receptacle, said support means including an elongated first retaining element which has first and second fastening means for connection to two spaced-apart locations on the peripheral upper edge of said side of said receptacle, and a second retaining element which has attachment means for adjustably attaching said second retaining element to said first retaining element in order to clamp said trunk therebetween, said first retaining element defining a recessed first support zone for a trunk and said second retaining element including a protruding portion which defines a recessed second support zone for a trunk, said protruding portion being extendable into said recessed first support zone of said first retaining element but never contacting said first retaining element.

2. A stand device as claimed in claim 1, wherein said first support zone has approximately in the middle thereof of a vertical groove.

3. A stand as claimed in claim 1, wherein said second retaining element presents, opposite to said protruding portion, a recess forming a potential supplementary support zone, in a reversed position of said second retaining element.

4. A stand as claimed in claim 1, wherein each of said retaining elements or one of them has several potential support zones in order to be adapted to the diameter of the trunk.

5. A device as claimed in claim 1, wherein said fixing means simultaneously forms said tightening

6. A stand device as claimed in claim 1, wherein said first retaining element is formed by a rod of one or more parts, having a length at least equal to the one of a top opening of said receptacle and carries said fastening means on each of its ends.

7. A stand device as claimed in claim 6, wherein said device comprises means for adjusting the length of said rod to the dimension of the opening of said receptacle.

8. A stand device as claimed in claim 6, wherein said rod has on one of its lateral faces a recess in shape of an arc of a circle having a radius corresponding approximately to a maximum radius of a trunk of a plant maintained inside, said recess forming said first support zone, which can optionally be provided with anti-friction means, such as a grooving.

9. A stand device as claimed in claim 1, wherein said first and second fastening means of the first retaining element comprise elongated holes provided at both ends of the latter, hook elements provided to cooperate with an upper border of said receptacle and going through said elongated holes, and tightening screws to be screwed at a threaded upper end of said hook elements.

10. A stand device as claimed in claim 1, wherein the first retaining element is fixed by one of its ends on a border of said receptacle by using fastening means enabling a rotation of said first retaining element around said fastening means.

11. A stand device as claimed in claim 1, wherein said attachment means comprise two shafts which jut out parallel to one of said retaining elements, at a distance which is longer than said diameter of said trunk of said plant, and over a length which is longer than said diameter, and wherein the free ends of these shafts are threaded and passed through perforations provided in a corresponding manner on said second retaining element, and wherein blocking screws are screwed on the ends of those shafts which jut out outside those perforations.

12. A stand device as claimed in claim 1, wherein said second retaining element is connected to said first retaining element by means of one of its ends, in such a mnanner than it is able to rotate with respect to said first retaining element.

13. A stand device as claimed in claim 1, wherein at least one of said retaining elements is made of an elastic resistant material, the elastic force of which serving as a force for bringing those retaining elements mutually together.

14. A stand device as claimed in claim 1, including means for stabilizing said receptacle which comprises a ballasting of said receptacle mainly formed by water, with which said receptacle is filled, the water simultaneously serving as feeding means to said plant and being optionally mixed with some liquified earth.

15. A stand device as claimed in claim 14, wherein, when said trunk is cut, said means for stabilizing optionally comprise moreover maintaining elements, which optionally are removable, and which are provided in said bottom of said receptacle.

16. A support means for supporting a plant having a large diameter trunk in a receptacle which has an upwardly-extending side that defines a peripheral upper edge, said support member comprising an elongated first retaining element which has first and second fastening means for connection to two spaced-apart locations on the peripheral upper edge of said side of said receptacle, said first retaining element comprising means for adjusting its length, and a second retaining element which has attachment means for adjustably attaching said second retaining element to said first retaining element in order to clamp said trunk therebetween.

17. A support means according to claim 16, wherein said first retaining element includes two spaced-apart elongated slots through which said respective first and second fastening means movably extend.

18. A support means according to claim 16, wherein said first retaining element comprises a telescopic rod device.

19. A support means according to claim 16, wherein each of said two retaining elements has at least one support zone for said trunk of said plant in a tightening position thereof and wherein said zones are shaped in such a manner that, in this position, there will always be at least four contact points between said trunk and said retaining elements.

* * * * *